US010975488B2

(12) United States Patent
Fleming et al.

(10) Patent No.: US 10,975,488 B2
(45) Date of Patent: Apr. 13, 2021

(54) METHOD OF MANUFACTURING A HEAT PIPE

(71) Applicant: Toyota Motor Engineering & Manufacturing North America, Inc., Erlanger, KY (US)

(72) Inventors: Evan B. Fleming, Ann Arbor, MI (US); Gaohua Zhu, Ann Arbor, MI (US)

(73) Assignee: Toyota Motor Engineering and Manufacturing North America, Inc., Plano, TX (US)

( * ) Notice: Subject to any disclaimer, the term of this patent is extended or adjusted under 35 U.S.C. 154(b) by 0 days.

(21) Appl. No.: 16/540,513

(22) Filed: Aug. 14, 2019

(65) Prior Publication Data

US 2021/0047747 A1 Feb. 18, 2021

(51) Int. Cl.

| | |
|---|---|
| ***C25D 5/50*** | (2006.01) |
| ***C25D 7/04*** | (2006.01) |
| ***C25D 5/48*** | (2006.01) |
| ***F28D 15/04*** | (2006.01) |

(52) U.S. Cl.

CPC ..... *C25D 5/50* (2013.01); *C25D 5/48* (2013.01); *C25D 7/04* (2013.01); *F28D 15/046* (2013.01)

(58) Field of Classification Search

CPC ..... C25D 5/48; C25D 5/50

See application file for complete search history.

(56) References Cited

U.S. PATENT DOCUMENTS

2006/0193889 A1 8/2006 Spradlin et al.

FOREIGN PATENT DOCUMENTS

| | | | | |
|---|---|---|---|---|
| CN | 106757234 A | * | 5/2017 | |
| CN | 108489311 A | | 9/2018 | |
| WO | WO-2008154926 A1 | * | 12/2008 | ..... B01J 25/00 |

OTHER PUBLICATIONS

Machine translation of CN108489311 of Hailan. (Year: 2018).*

Machine translation of CN 106757234 of Hao. (Year: 2017).*

Lu et al., "Three-dimensional bicontinuous nanoporous materials by vapor phase dealloying," Nature Communications,Jan. 18, 2018, 7 pages.

Song et al., "Creation of bimodal porous copper materials by an annealing-electrochemical dealloying approach," Electrochimica Acta 164, Feb. 26, 2015, pp. 288-296.

Tang et al., "Pool-boiling enhancement by novel metallic nanoporous surface," Experimental Thermal and Fluid Science 44, Jun. 18, 2012, pp. 194-198.

* cited by examiner

*Primary Examiner* — Brian W Cohen

(74) *Attorney, Agent, or Firm* — Jordan IP Law, LLC

(57) ABSTRACT

A method of manufacturing a heat transfer device includes manipulating the microstructure of a metal alloy to thereby remove one or more chemical components of the alloy to form resultant heat pipe structure having an envelope composed of the precursor metal alloy and a porous wick structure composed of the dealloyed metal. Manipulation of the microstructure may be conducted by selective etching of a substrate composed of a metal or metal alloy using a dealloying process.

10 Claims, 5 Drawing Sheets

METHOD OF MANUFACTURING A HEAT PIPE

TECHNICAL FIELD

Embodiments relate generally to a heat transfer device, and a method of manufacturing thereof. More particularly, embodiments relate to a method of manufacturing a heat pipe having a porous wick structure composed of a dealloyed metal, and a method of manufacturing a wick structure composed of a dealloyed metal having a porous microstructure.

BACKGROUND

Heat pipes are a general class of passive two-phase (liquid/vapor) heat transfer devices used in thermal management for a wide variety of applications and industries. While there are many types of heat pipes, all traditional heat pipes rely on passive liquid transport by capillary action that is generated by a wick structure. Commercially-available wick structures are typically sintered copper powders or copper mesh screens. For certain applications requiring long heat pipe lengths, and/or a thin heat pipe profile, and/or high heat load, and/or low thermal resistance, some heat pipe designs have yielded unsatisfactory results.

BRIEF SUMMARY

In an embodiment, a method of manufacturing a heat pipe may comprise at least one of the following: selectively etching one or more metal components from a metal alloy substrate to form the heat pipe having an outer surface composed of the metal alloy and an inner surface defining a microporous or nanoporous wick structure extending directly from the outer surface, wherein the porous wick structure is composed of a dealloyed metal.

In another embodiment, a method of manufacturing a heat pipe may comprise at least one of the following: conducting an electroplating process on a metal substrate; conducting a heat treatment to create a thin locally alloyed region on top of the metal substrate; and selectively etching the locally alloyed region by chemical etching to form the heat pipe having an outer substrate composed of the original metal outer layer and an inner surface defining a porous wick structure extending directly from the substrate, wherein the porous wick structure is composed of a dealloyed metal.

In another embodiment, a method of manufacturing a heat pipe may comprise at least one of the following: conducting an electroplating process on a metal substrate; conducting a heat treatment to create a thin locally alloyed region on top of the bulk substrate; and selectively etching the metal alloy layer by vapor phase dealloying, a.k.a., vacuum dealloying, to form the heat pipe having an outer substrate composed of the original metal outer layer and an inner surface defining a microporous wick structure extending directly from the substrate, wherein the microporous wick structure is composed of a dealloyed metal.

In an additional embodiment, a method of manufacturing a heat pipe may comprise at least one of the following: conducting an electroplating process on a metal structure; conducting a heat treatment on the electroplated metal structure to form a composite structure having a metal outer layer and a metal alloy inner layer; and manipulating the microstructure of the metal alloy inner layer to form the heat pipe having an outer surface composed of the metal outer layer and an inner surface defining a porous wick structure extending directly from the outer surface, wherein the porous wick structure is composed of a dealloyed metal.

In yet another embodiment, a method of manufacturing a heat transfer device may comprise at least one of the following: selectively etching one or more chemical components from a metal alloy structure to form the heat pipe having an outer surface composed of the metal alloy and an inner surface defining a porous wick structure extending directly from the outer surface, wherein the porous wick structure is composed of a dealloyed metal.

In yet a further embodiment, a method of manufacturing a heat transfer device may comprise at least one of the following; conducting an electroplating process on a metal structure; conducting a heat treatment on the electroplated metal structure to form a structure having a metal outer layer and a metal alloy inner layer; and selectively etching the metal alloy inner layer to form the heat pipe having an outer surface composed of the metal outer layer and an inner surface defining a porous wick structure extending directly from the outer surface, wherein the porous wick structure is composed of a dealloyed metal.

In still another embodiment, a method of manufacturing a wick structure for a heat transfer device may comprise at least one of the following: conducting an electroplating process on a metal structure; conducting a heat treatment on the electroplated metal structure to form a composite structure having a metal outer layer and a metal alloy inner layer; and manipulating the microstructure of the metal alloy inner layer to form the heat pipe having an outer surface composed of the metal outer layer and an inner surface defining a porous wick structure extending directly from the outer surface, wherein the porous wick structure is composed of a dealloyed metal.

BRIEF DESCRIPTION OF THE SEVERAL VIEWS OF THE DRAWINGS

The various advantages of the embodiments of the present invention will become apparent to one skilled in the art by reading the following specification and appended claims, and by referencing the following drawings, in which:

DETAILED DESCRIPTION

Figure 1:
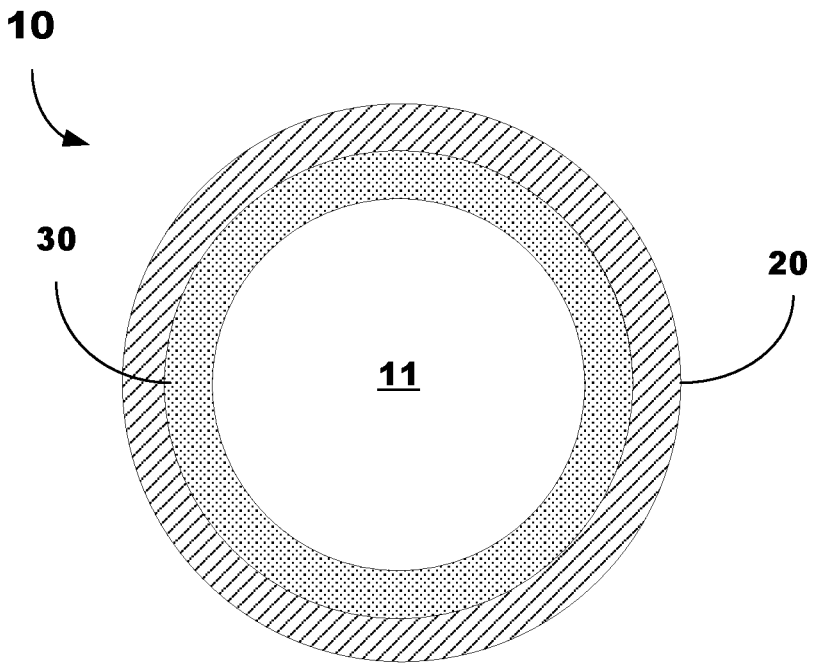
FIG. 1 is a front cross-sectional view of an example of a heat pipe, in accordance with embodiments.

As illustrated in FIG. 1, a heat transfer device/cooling device, such as, for example, a heat pipe 10 having an enclosed sealed structure (not illustrated) comprising an outer portion serving as a heat pipe envelope 20 and an inner layer serving as a wick structure 30 to define an internal heat pipe chamber 11 configured to receive and hold a working liquid for flow of the working fluid and vapor therethrough. Although the illustrated heat pipe 10 has a substantially cylindrical cross-section, embodiments are not limited therewith, and thus, may encompass a planar structural configuration or any other geometric structural configuration that falls within the spirit and scope of the principles of this disclosure set forth herein.

In accordance with embodiments, the microstructure of a precursor metal alloy is manipulated to yield a wick structure 30 comprising a porous metal or a porous metal alloy. Such a porous metal or porous metal alloy is the resultant of the selective chemical disassociation, removal, or dissolution of one or more chemical components from the metal alloy material. The remaining precursor alloy material is to form the heat pipe envelope 20. By controlling the microstructure of the metal alloy, for example, through the selective chemical disassociation, removal, or dissolution of one or more chemical components from the metal alloy structure, a porous wick material is formed.

In accordance with embodiments, the microstructure and porosity can be controlled by controlling the metal alloy composition, use of metal alloy annealing, and by the dealloying process parameters.

In accordance with embodiments, the chemical composition of the heat pipe envelope 20 is to be that of a metal or a metal alloy. Such a metal alloy may comprise, for example, one that has copper as a principal chemical component. Embodiments, however, are not limited thereto, and thus, the heat pipe envelope 20 may be composed of other materials that fall within the spirit and scope of the principles of this disclosure set forth herein.

Figure 2:
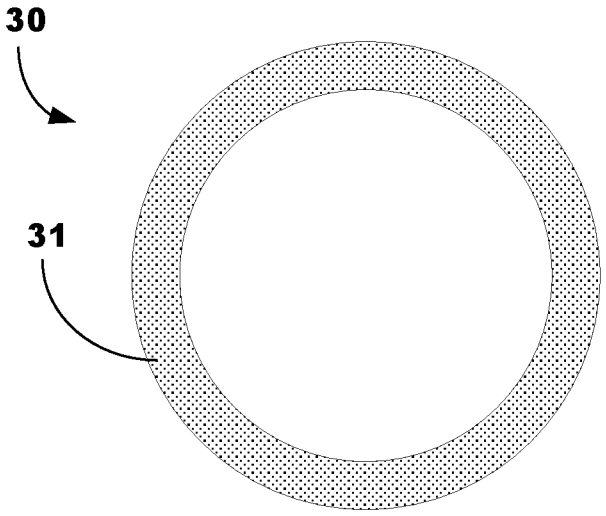
FIG. 2 is a front cross-sectional view of a wick structure for the heat pipe of FIG. 1.

As illustrated in FIG. 2, the inner surface of the heat pipe 10, to serve as the wick structure 30, such as, for example, one that is manufactured in accordance with embodiments, is to be formed from the precursor alloy material. The resultant wick structure 30 formed by the dealloying, or selective etching, or manipulation of the microstructure of the precursor metal alloy has a material composition that includes a plurality of micro-sized or nano-sized pores 31 throughout that enhances the capillary action and the thermal conductivity of the wick structure 30. The wick structure 30 is formed to radially or laterally extend in a direction inwardly from the heat pipe envelope 20 to thereby define the internal heat pipe chamber 11. In the illustrated embodiment, the wick structure 30 may extend from the heat pipe envelope 20 in a substantially radially concentrically manner.

In operation of the heat pipe 10, due to the microporous microstructure of the material forming the wick structure 30, condensed vapor at a condenser region of the heat pipe 10 is to flow by capillary action through the wick structure 30 to an evaporator region of the heat pipe 10. A physical property of the wick structure 30, therefore, is to exhibit permeability, i.e., minimizing liquid flow resistance through the wick structure 30. Accordingly, it is necessary to provide the wick structure 30 with a minimal pore size that maximizes: (i) the capillary pumping power of the wick structure 30, and (ii) the thermal conductance of the wick structure 30. In this regard, in accordance with embodiments, the wick structure 30 comprises a porous microstructure formed from a dealloyed metal using the method(s) described herein. As to be further described herein, such a wick structure 30 may be manufactured via a method in accordance with embodiments.

Figure 3:
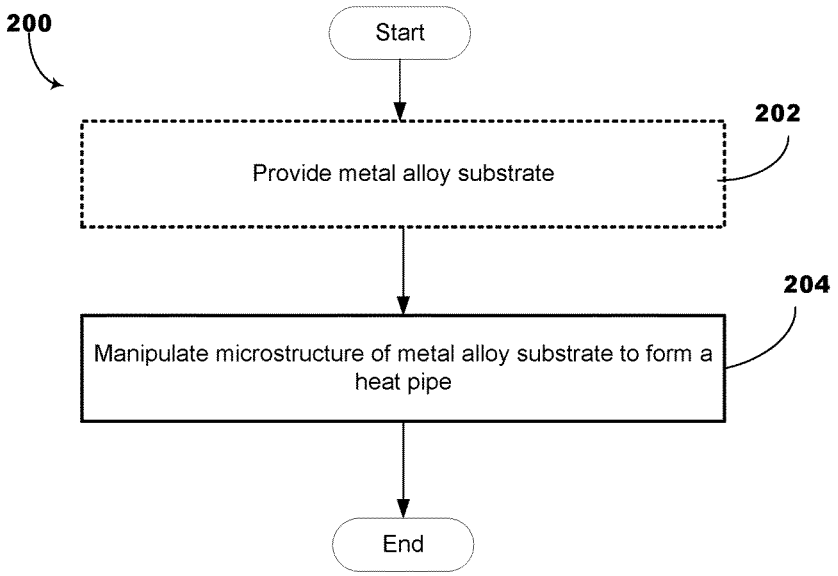
FIG. 3 is a flowchart of an example of a method of manufacturing a heat pipe, in accordance with an embodiment.
Figure 4:
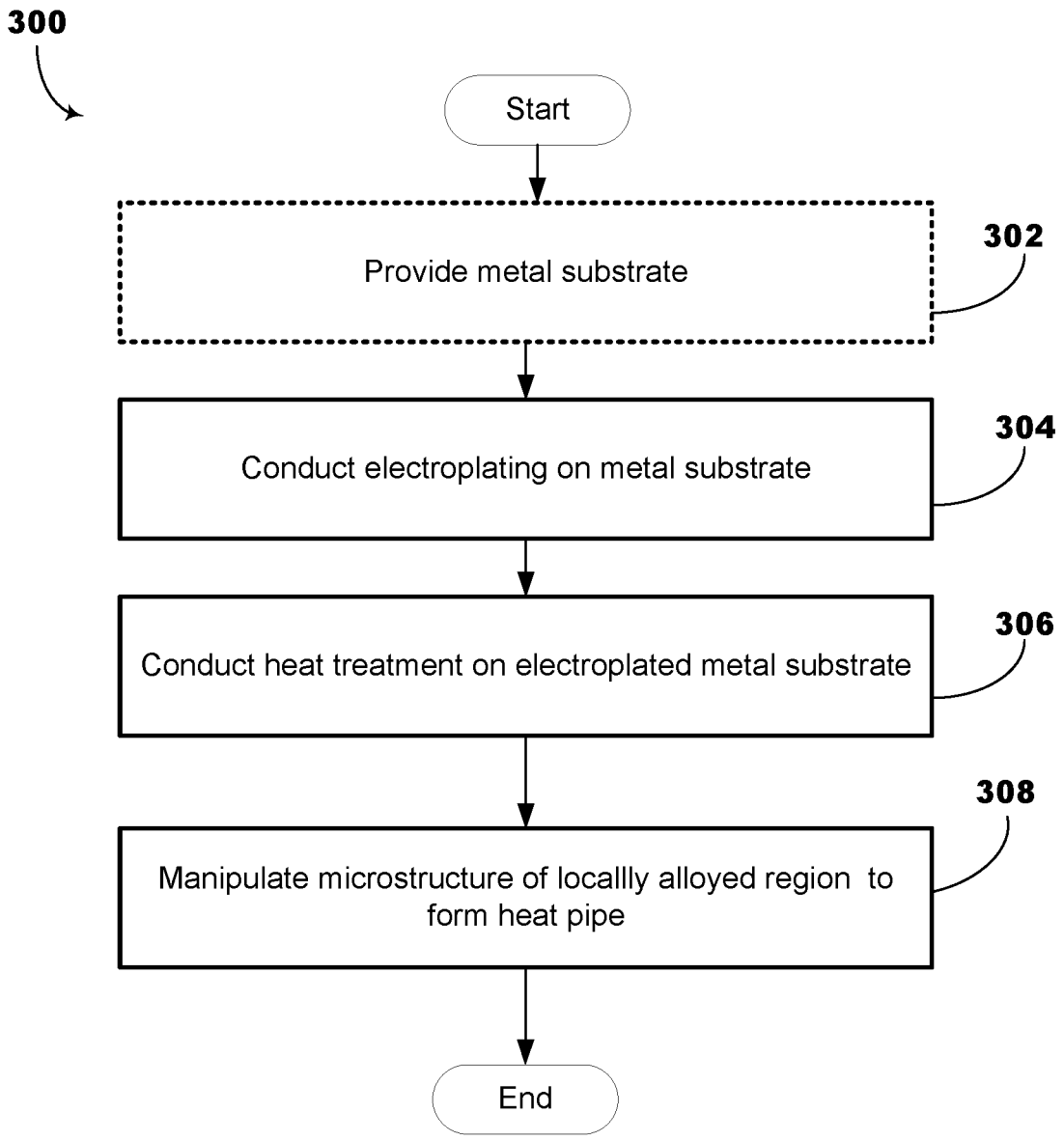
FIG. 4 is a flowchart of an example of a method of manufacturing a heat pipe, in accordance with another embodiment.
Figure 5:
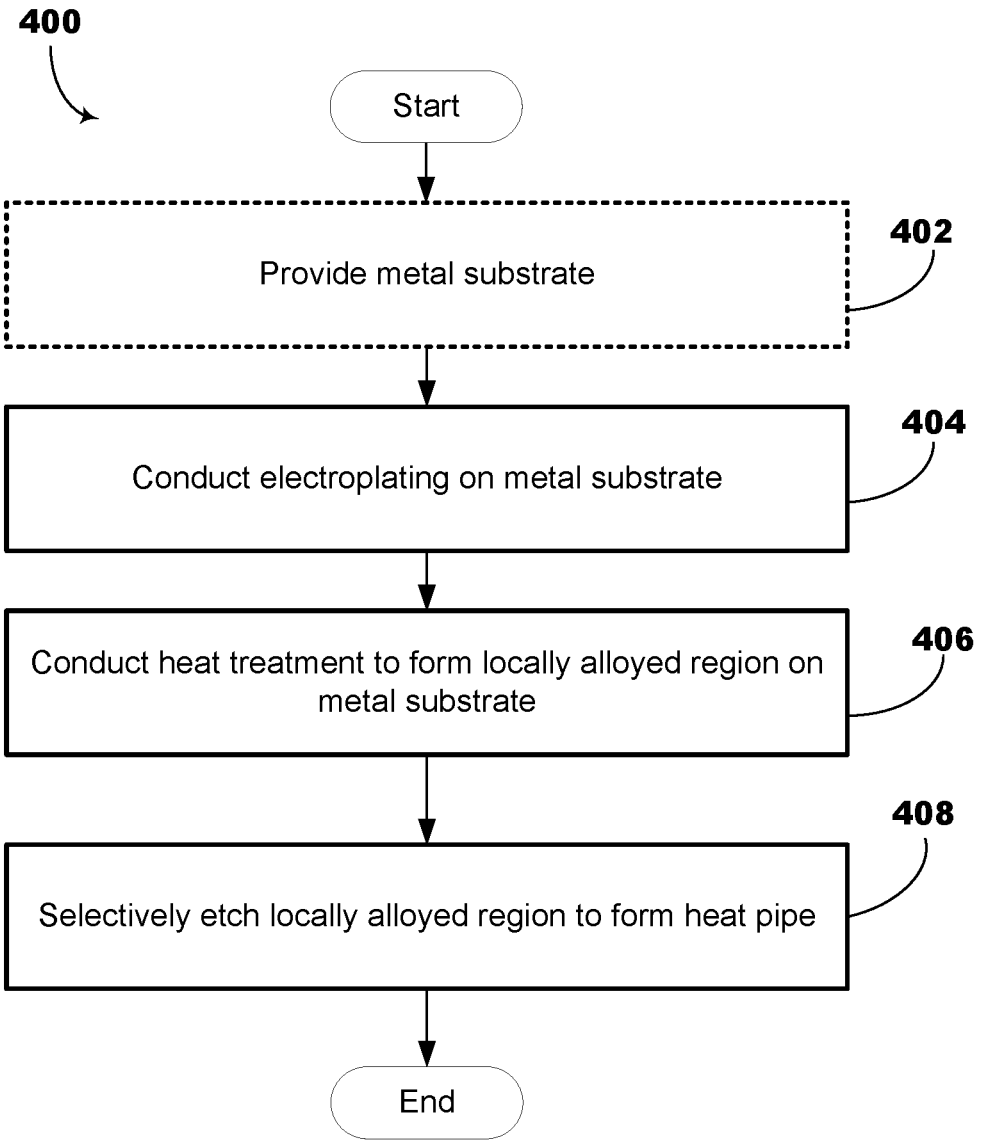
FIG. 5 is a flowchart of a method of manufacturing a wick structure for the heat pipe of FIG. 1, in accordance with an embodiment.

As illustrated in FIGS. 3 to 5, methods 200, 300, and 400 of manufacturing a heat pipe is provided. Each respective method 200, 300, and 400 is to fabricate a wick structure that is scalable and manufactured at a low-cost when compared to conventional methods. Such a heat pipe, for example, may comprise the heat pipe 10 illustrated in FIG. 1. In accordance with embodiments, each respective method 200, 300, and 400 may be implemented, for example, in logic instructions (e.g., software), configurable logic, fixed-functionality hardware logic, etc., or any combination thereof.

As illustrated in FIG. 3, at illustrated processing block 202, a metal alloy structure is provided. Alternatively, practice of the method 200 in accordance with embodiments may commence with processing block 204.

Such a metal alloy structure may comprise, for example, a metal alloy. In accordance with embodiments, such a metal alloy may comprise, for example, a copper-based alloy. Embodiments, however, are not limited thereto, and thus, practice of the method 200 may employ any metal alloy that falls within the spirit and scope of the principles of this disclosure set forth herein. The structural configuration of the metal alloy structure may comprise a hollow cylindrical structure or a hollow rectangular structure. Embodiments, however, are not limited thereto, and thus, practice of the method 200 may employ any geometric structural configuration that falls within the spirit and scope of the principles of this disclosure set forth herein.

At illustrated processing block 204 the microstructure of the metal alloy structure is to be manipulated, thereby forming a resultant heat pipe structure.

The heat pipe structure comprises an outer surface/envelope composed of the precursor metal alloy and an inner surface/wick structure composed of a dealloyed metal. Manipulation of the microstructure of the metal alloy structure may comprise, for example, selectively etching a predetermined region of the metal alloy structure. As an example, in this regard, the inner surface of the metal alloy structure may be selectively etched using a dealloying process. The dealloying process may comprise, for example, electro-chemical, vacuum, or vapor-phase dealloying. Embodiments, however, are not limited thereto, and thus, practice of the method 200 may employ any dealloying process that falls within the spirit and scope of the principles of this disclosure set forth herein.

As illustrated in FIG. 4, at illustrated processing block 302, a metal structure is provided. Alternatively, practice of the method 300 in accordance with embodiments may commence with processing block 304.

Such a metal structure may comprise, for example, copper. Embodiments, however, are not limited thereto, and thus, practice of the method 300 may employ any metal that falls within the spirit and scope of the principles of this disclosure set forth herein. The structural configuration of the metal alloy structure may comprise a hollow cylindrical structure or a hollow rectangular structure. Embodiments, however, are not limited thereto, and thus, practice of the method 300 may employ any alloy and geometric structural configuration that falls within the spirit and scope of the principles of this disclosure set forth herein.

At illustrated processing block 304, an electroplating process is conducted/performed on the metal structure to form a layer of a second metal on the inner surface of the metal structure.

At illustrated processing block 306, a heat treatment process is conducted/performed on the electroplated metal structure to transform the previously formed electroplated inner layer into a metal alloy layer. The heat treatment thereby forms an inner layer composed of a metal alloy on the inner surface of metal structure. The structure, therefore, comprises an outer layer composed of metal and an inner layer composed of a metal alloy.

At illustrated processing block 308, the microstructure of the metal alloy inner layer is manipulated to form the resultant heat pipe having an outer surface composed of the metal outer layer and an inner surface composed of a dealloyed metal having a porous wick structure. Manipulation of the microstructure of the metal alloy inner layer may comprise, for example, selectively etching the metal alloy inner layer using a dealloying process. The dealloying process may comprise, for example, electro-chemical, vacuum, or vapor-phase dealloying. Embodiments, however, are not limited thereto, and thus, practice of the method 300 may employ any dealloying process that falls within the spirit and scope of the principles of this disclosure set forth herein.

As illustrated in FIG. 5, at illustrated processing block 402, a metal structure is provided. Such a metal structure may comprise, for example, copper. Embodiments, however, are not limited thereto, and thus, practice of the method 300 may employ any metal that falls within the spirit and scope of the principles of this disclosure set forth herein. The structural configuration of the metal alloy structure may comprise a hollow cylindrical structure or a hollow rectangular structure. Embodiments, however, are not limited thereto, and thus, practice of the method 400 may employ any alloy and geometric structural configuration that falls within the spirit and scope of the principles of this disclosure set forth herein.

At illustrated processing block 404, an electroplating process is conducted/performed on the metal structure. Alternatively, practice of the method 400 in accordance with embodiments may commence with processing block 404.

At illustrated processing block 406, a heat treatment process is conducted/performed on the electroplated metal structure. The heat treatment thereby forms a resultant composite structure comprising an outer layer composed of metal and an inner layer composed of a metal alloy.

At illustrated processing block 408, the metal alloy inner layer is selectively etched to form the resultant heat pipe having an outer surface composed of the metal outer layer and an inner surface composed of a dealloyed metal having a porous wick structure. The dealloying process may comprise, for example, electro-chemical, vacuum, or vapor-phase dealloying. Embodiments, however, are not limited thereto, and thus, practice of the method 300 may employ any dealloying process that falls within the spirit and scope of the principles of this disclosure set forth herein.

Figure 6:
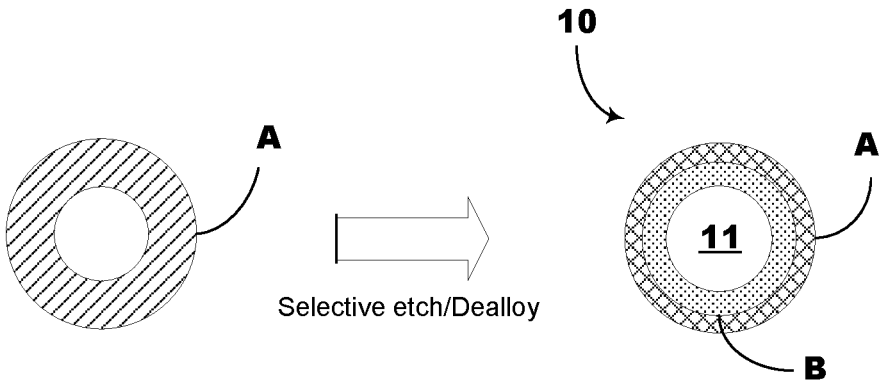
FIG. 6 is a schematic diagram of a method of manufacturing a wick structure for the heat pipe of FIG. 1, in accordance with an embodiment.

As illustrated in FIG. 6, an example of the method 200 is provided. Initially, a hollow cylindrical structure composed of a metal alloy A is provided. Such a metal alloy may comprise, for example, brass, which is an alloy of copper and zinc. The hollow cylindrical structure composed of brass is then selectively etched using a dealloying process (e.g., electro-chemical, vacuum, or vapor-phase) to selectively remove a specific chemical component, e.g., zinc, from the alloy.

A heat pipe structure 10 is thereby formed having an outer surface composed of the precursor metal alloy (brass) A, and an inner surface composed of a dealloyed metal (copper) B that remains from the dealloying. The formed wick structure defines the internal heat pipe chamber 11, and includes a porous microstructure having an enhanced capillary effect and thermal conductivity.

Figure 7:
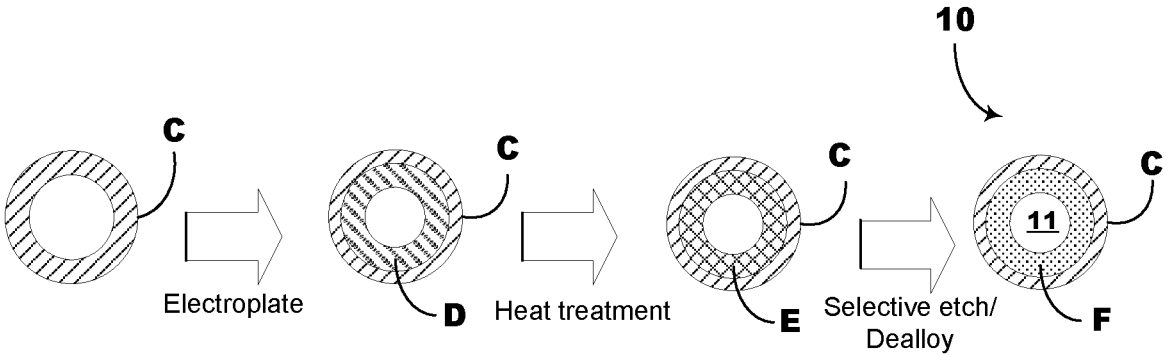
FIG. 7 is a schematic diagram of an example of a method of manufacturing a wick structure for the heat pipe of FIG. 1, in accordance with another embodiment.

As illustrated in FIG. 7, an example of the methods 300, 400 is provided. Initially, a hollow cylindrical structure composed of a metal C is provided. Such a metal may comprise, for example, copper. The hollow cylindrical structure composed of copper is then electroplated to form a layer of a second metal D on the inner surface of the metal structure. The metal may comprise, for example, zinc. The composite copper-zinc structure previously-formed by electroplating then undergoes a heat treatment process to form an inner layer composed of a metal alloy E. The metal alloy inner layer comprises copper and zinc.

The metal alloy inner layer of the hollow cylindrical structure is then selectively etched using a dealloying process (e.g., electro-chemical, vacuum, or vapor-phase) to selectively remove a specific chemical component, e.g., zinc, from the metal alloy inner layer.

A heat pipe structure 10 is thereby formed having an outer surface composed of metal (copper) C, and an inner surface composed of a dealloyed metal (copper) F that remains from the dealloying. The formed wick structure defines the internal heat pipe chamber 11, and includes a porous microstructure having an enhanced capillary effect and thermal conductivity.

The terms "coupled," "attached," or "connected" may be used herein to refer to any type of relationship, direct or indirect, between the components in question, and may apply to electrical, mechanical, fluid, optical, electromagnetic, electromechanical or other connections. In addition, the terms "first," "second," etc. are used herein only to facilitate discussion, and carry no particular temporal or chronological significance unless otherwise indicated.

Those skilled in the art will appreciate from the foregoing description that the broad techniques of the embodiments of the present invention can be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A method of manufacturing a heat pipe, the method comprising:

conducting an electroplating process on a metal substrate to form a metal composite structure;

conducting a heat treatment on the metal composite structure to form a locally alloyed region on an inner surface of the metal substrate; and manipulating a microstructure of the locally alloyed region by selectively etching the locally alloyed region via a dealloying process to form the heat pipe having an outer layer to serve as a heat pipe envelope composed of the metal substrate and an inner surface to serve as a wick structure composed of a dealloyed metal having a porous wick structure formed from the locally alloyed region.

2. The method of claim 1, wherein the heat pipe comprises:

a hollow cylindrical structure, such that the porous wick structure is to extend radially inward from the metal substrate, or a hollow rectangular structure, such that the porous wick structure is to extend laterally inward from the metal substrate.

3. The method of claim 1, wherein the dealloying process comprises electro-chemical dealloying.

4. The method of claim 1, wherein the dealloying process comprises vacuum dealloying.

5. The method of claim 1, wherein the dealloying process comprises vapor-phase dealloying.

6. A method of manufacturing a heat pipe, the method comprising:

conducting an electroplating process on a metal substrate composed of a first metal to form a metal composite structure that includes an inner layer composed of a second metal and an outer layer comprising the metal substrate;

conducting a heat treatment on the electroplated metal composite structure to transform the inner layer composed of the second metal into a metal alloy layer formed on the metal substrate; and selectively etching the metal alloy layer, via a dealloying process, to form the heat pipe having an outer layer to serve as a heat pipe envelope composed of the metal substrate and an inner surface to serve as a wick structure composed of a dealloyed metal having a porous wick structure formed from the metal alloy layer.

7. The method of claim 6, wherein the heat pipe comprises:

a hollow cylindrical structure, such that the porous wick structure is to extend radially inward from the metal substrate, or a hollow rectangular structure, such that the porous wick structure is to extend laterally inward from the metal substrate.

8. The method of claim 6, wherein the dealloying process comprises electro-chemical dealloying.

9. The method of claim 6, wherein the dealloying process comprises vacuum dealloying.

10. The method of claim 6, wherein the dealloying process comprises vapor-phase dealloying.

* * * * *